US008402782B2

(12) United States Patent
Kim et al.

(10) Patent No.: US 8,402,782 B2
(45) **Date of Patent: *Mar. 26, 2013**

(54) ICE-MAKING DEVICE FOR REFRIGERATOR

(75) Inventors: Young Jin Kim, Seoul (KR); Tae Hee Lee, Seoul (KR); Hong Hee Park, Seoul (KR); Ho Youn Lee, Seoul (KR); Joon Hwan Oh, Seoul (KR)

(73) Assignee: LG Electronics Inc., Seoul (KR)

( * ) Notice: Subject to any disclaimer, the term of this patent is extended or adjusted under 35 U.S.C. 154(b) by 914 days.

This patent is subject to a terminal disclaimer.

(21) Appl. No.: 12/379,610

(22) Filed: Feb. 25, 2009

(65) Prior Publication Data

US 2009/0217692 A1 Sep. 3, 2009

(30) Foreign Application Priority Data

Feb. 28, 2008 (KR) ..... 10-2008-0018077

(51) Int. Cl.
*F25C 1/00* (2006.01)

(52) U.S. Cl. ..... 62/353; 62/139; 62/344; 62/345; 62/349; 62/351

(58) Field of Classification Search ..... 62/66, 71, 62/73, 77, 133, 135, 139, 340, 345, 346, 62/349, 351, 353, 354

See application file for complete search history.

(56) References Cited

U.S. PATENT DOCUMENTS

| | | | | |
|---|---|---|---|---|
| 3,298,189 | A * | 1/1967 | Beck et al. | 62/135 |
| 3,418,823 | A | 12/1968 | Bartoli | |
| 3,783,636 | A * | 1/1974 | Archer | 62/353 |
| 4,896,513 | A * | 1/1990 | Troscinski | 62/351 |
| 5,187,948 | A | 2/1993 | Frohbieter | |
| 5,297,394 | A * | 3/1994 | Frohbieter et al. | 62/135 |
| 5,425,243 | A * | 6/1995 | Sanuki et al. | 62/138 |
| 5,836,168 | A * | 11/1998 | Lee | 62/129 |
| 6,148,620 | A * | 11/2000 | Kumagai et al. | 62/72 |
| 6,658,869 | B1 | 12/2003 | Thornbrough | |
| 6,688,131 | B1 * | 2/2004 | Kim et al. | 62/353 |

FOREIGN PATENT DOCUMENTS

EP 0580 950 A1 2/1994

* cited by examiner

*Primary Examiner* — Cheryl J Tyler
*Assistant Examiner* — Paolo Gonzalez
(74) *Attorney, Agent, or Firm* — McKenna Long & Aldridge LLP

(57) ABSTRACT

An ice-making device designed to make and separate ice from an ice tray through a simple process is provided. The ice-making device includes an ice tray defining an ice-making space, a freezing core that is partly received in the ice-making space to make ice at an end thereof, a driving unit moving and rotating the freezing core, and a power transmission unit for transferring power from the driving unit to the freezing core. The power transmission unit including a cam unit rotatably connected to the driving unit and a moving member that moves in vertical and rotational direction by a driving force of a motor transferred by the cam unit.

17 Claims, 13 Drawing Sheets

ICE-MAKING DEVICE FOR REFRIGERATOR

CROSS-REFERENCE TO RELATED APPLICATIONS

The present application claims priority under 35 U.S.C. 119 and 35 U.S.C. 365 to Korean Patent Application No. 10-2008-0018077, filed on Feb. 28, 2008, which is hereby incorporated by reference in its entirety.

BACKGROUND

The present disclosure relates to an ice-making device for a refrigerator, and more particularly, to an ice-making device for a refrigerator, which is designed to effectively separate ice through a simple process.

Generally, a refrigerator is used to store food or other things at a low temperature. The refrigerator has a plurality of storage chambers for storing the food. Each of the storage chambers has an opened side to permit a user to access the storage chamber, to put things therein and to take things therefrom.

Recently, a refrigerator having a dispenser for dispensing ice and water has been developed. A water tank for storing water that will be dispensed and supplied to an ice-making device is connected to the dispenser.

The ice-making device for making ice using the water supplied is provided in the refrigerator. The ice-making device may be installed in a main body of the refrigerator or a door of the refrigerator.

The ice-making device may be provided in a chilling chamber. In this instance, the ice-making device is formed in a thermal insulation structure, in order to maintain ice-making device at a sufficiently low temperature environment, even though it is disposed in the main body of the refrigerator or the door of the refrigerator. A passage through which cool air of a freezing chamber can be introduced and discharged into and from the ice-making device is formed through side surfaces of the ice-making device and the refrigerator.

An ice tray in which the water is supplied and frozen is provided in the ice-making device. That is, the cool air is supplied when the ice tray is filled with the water ready to be frozen into ice.

Meanwhile, in a typical ice-making device, a heater is provided at a side of the ice tray. The heater is used to separate the ice from the ice tray, by heating the ice tray. In such a typical device, a structure that directs the ice separated from the ice tray to an ice bank is complicated.

In addition, when the ice separated from the ice tray falls down to the ice bank, the ice may interfere with a part of the ice-making device and thus the ice may not be effectively dispensed.

SUMMARY

Embodiments provide an ice-making device for a refrigerator, which is designed to efficiently separate ice through a simple operation.

Embodiments also provide an ice-making device for a refrigerator, which has a cam unit and a plurality of shafts coupled to guide grooves in a surface of the cam unit, that together enable a freezing core and an ice tray to move in a vertical direction relative to one another and rotate, thereby allowing the ice that is made to fall from the freeing core or the ice tray into an ice bank.

Embodiments also provide an ice-making device for a refrigerator, which has a cam unit provided with guide grooves guiding a plurality of shafts in vertical and rotating directions.

In one embodiment, an ice-making device for a refrigerator, may include: an ice tray defining an ice-making space; a freezing core that is partially received in the ice-making space to form ice at an end thereof; a driving unit generating a driving force that causes vertical and rotational movement of the freezing core; and a power transmission unit to transfer power from the driving unit to the freezing core. The power transmission unit may include: a cam unit rotatably connected to the driving unit; and a moving member communicating with the cam unit and following a vertical and a rotational path as guided by the cam unit In another embodiment, an ice-making device for a refrigerator may include: an ice tray defining an ice-making space; a freezing core that is partially received in the ice-making space to form ice at an end thereof; a drive unit generating a rotational drive force to move and rotate the freezing core; a cam unit receiving the drive force and rotating in accordance with the drive unit, the cam unit provided with at least an inner and an outer guide groove formed in a surface of the cam unit that is parallel to a plane of rotation of the cam unit; and a moving member receiving the drive force from the cam unit, and transferring the drive force to the freezing core, wherein the moving member may include first and second shafts that are received in the inner and outer grooves, respectively.

In still another embodiment, an ice-making device for a refrigerator may include: an ice tray to receive water; a driving motor to generate a driving force; a freezing core movable along a vertical and rotational path; a cam unit transferring the driving force to effect movement of the freezing core; a plurality of shafts movably received in the cam unit and transferring the driving force to the freezing core, wherein the cam unit may include: a plurality of curved guide grooves guiding vertical and rotational movement of the shafts about a rotational center; wherein the curved guide grooves have different radii with respect to the rotational center.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Figure 1:
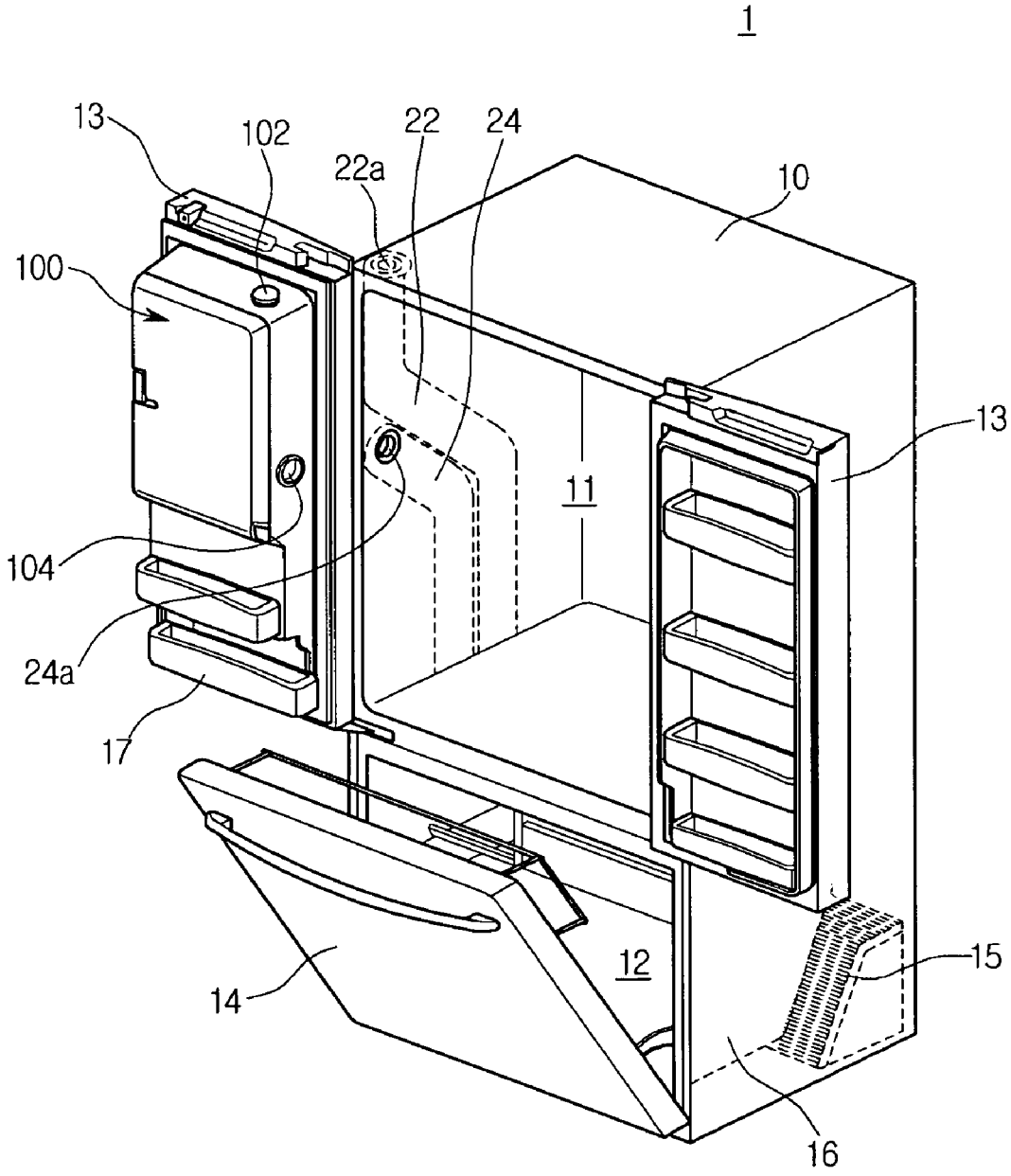
FIG. 1 is a perspective view of a refrigerator with an ice-making device according to a first embodiment of the invention.

FIG. 1 is a perspective view of a refrigerator with an ice-making device according to a first embodiment of the invention.

Referring to FIG. 1, a refrigerator 1 includes a main body 10 having a chilling chamber 11 and a freezing chamber 12, chilling doors 13 may each be pivotally coupled to a front portion of the main body 10 to selectively open and close the chilling chamber 11. A freezing door 14 may be provided on a lower-front portion of the main body 10 to selectively open and close the freezing chamber 12. Here, the chilling chamber 11 is defined at an upper portion of the main body 10 and the freezing chamber 12 is defined at a lower portion of the main body 10, however, other juxtapositions of the chilling chamber 11 and the freezing chamber 12 are within the scope of the invention.

For purposes of explanation only, the exemplary embodiment described herein utilizes a bottom-freezer type refrigerator, where the freezing chamber is defined under the chilling chamber. However, the present invention is not limited to this embodiment. For example, the present invention may be applied to not only a top-mount type refrigerator, where the freezing chamber is defined above the chilling chamber, but also a side-by-side type refrigerator where the freezing and chilling chambers are defined at right and left sides, respectively.

In more detail, the chilling doors 13 may be divided into two sections that are respectively coupled to both sides of the main body 10 by hinges (not shown). The freezing door 14 is coupled to a lower end of the main body 10. The freezing door may be coupled by a hinge (not shown) as illustrated in FIG. 1. Alternatively, for example, the freezing door may serve as the front of a freezing storage chamber, coupled to the main body on slides, all designed to be withdrawn from the main body 10 in the form of a drawer.

In addition, an evaporator 15 for generating cool air that will be supplied into the main body 10 may be provided at a lower-rear portion of the main body 10. A storage chamber 16 for storing foodstuffs may be provided in the freezing chamber 12 and may be capable of being withdrawn.

An ice-making device 100 for making ice and a plurality of baskets 17 for receiving a variety of foodstuffs may be provided on an inner surface of each chilling door 13.

The ice-making device 100 may be provided with a cool air inlet 102 through which cool air is supplied from the freezing chamber 12 and a cool air outlet 104 through which the cool air circulating throughout the ice-making device 100 is discharged toward the evaporator 15.

A cool air supply duct 22 for supplying the cool air to the cool air inlet 102 and a discharge duct 24 to which the cool air is discharged from the cool air outlet 104 are provided at a side of the main body 10.

First ends of the cool air supply and discharge ducts 22 and 24 are connected to the freezing chamber 12. A part of the cool air generated by the evaporator 15 is supplied to the ice-making device 100 through the cool air supply duct 22. The cool air circulating throughout the ice-making device 100 is discharged into the freezing chamber 12 through the cool air discharge duct 24.

Duct supply and discharge holes 22*a* and 24*a* are respectively formed on second ends of the cool air supply and discharge ducts 22 and 24, respectively. The duct supply and discharge holes 22*a* and 24*a*, respectively communicate with the cool air inlet and outlet 102 and 104, respectively.

Here, the duct supply and discharge holes 22*a* and 24*a* are exposed on an inner surface of the main body 10 corresponding to the cool air inlet and outlet 102 and 104, respectively. More specifically, when the chilling door 13 is closed, the duct supply and discharge holes 22*a* and 24*a* fluidly communicate with the cool air inlet and outlet 102 and 104, respectively.

Figure 2:
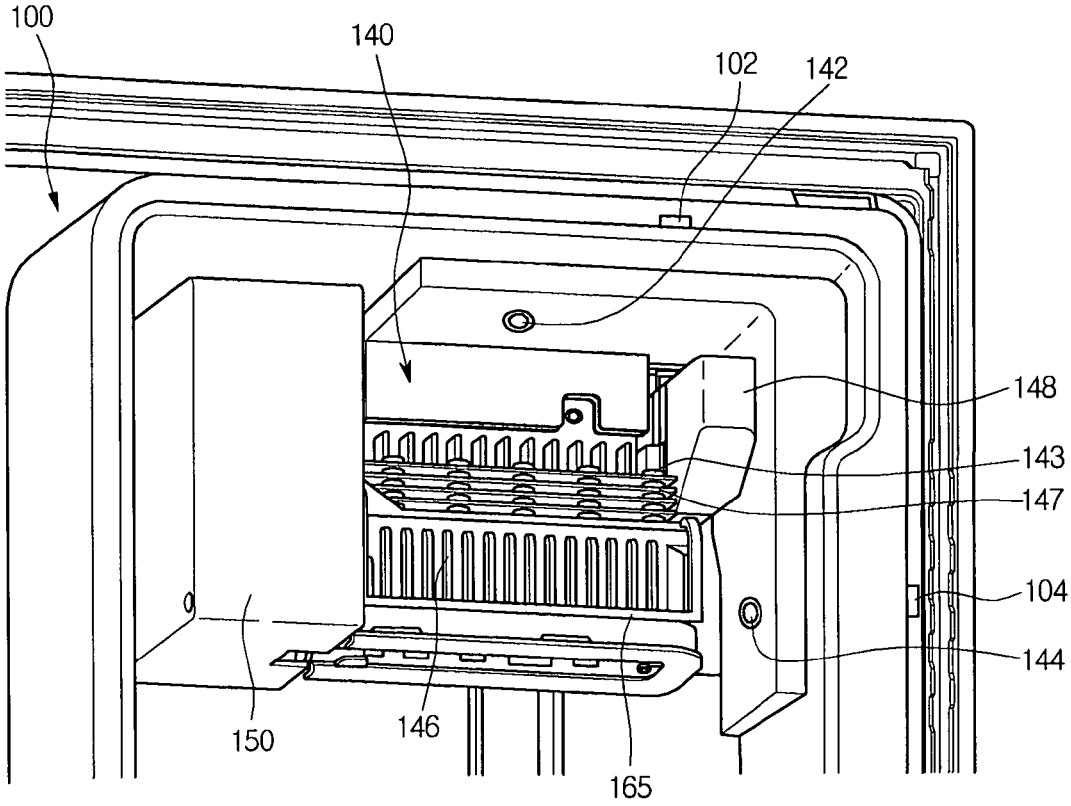
FIG. 2 is a perspective view illustrating an internal structure of the ice-making device of FIG. 1.

FIG. 2 is a perspective view illustrating an internal structure of the ice-making device of FIG. 1.

Referring to FIG. 2, the ice-making device 100, which is designed to make ice and allow a user to use the ice, is provided at the inner surface of the chilling door 12.

In more detail, the ice-making device 100 includes an ice-making unit 140 for making the ice using supplied water, an ice bank (not shown) that is disposed under the ice-making unit 140 to receive and store the ice made by the ice-making unit 140, and a dispenser (not shown) for dispensing the ice stored in the ice bank.

The following will describe the structure of the ice-making unit 140 in more detail.

The ice-making unit 140 includes a water supply unit 148 for supplying water from an external source, an ice tray 146 in which the water supplied from the water supply unit 148 is frozen into ice, one or more freezing cores 143 for freezing the water supplied into the ice tray 146, and one or more heat transferring fins 147 for effectively transferring heat from the freezing cores 143.

In more detail, the freezing cores 143 are provided above the ice tray 146. In order to use space efficiently, the freezing cores 143 may be arranged along at least two parallel and adjacent lines, so that a plurality of ice cubes can be made.

The freezing cores 143 may be formed in a cylindrical shape extending in a vertical direction. At least a portion of each of the freezing cores 143 is received in an ice-making space 146*a* (FIG. 4) of the ice tray 146.

Further, each heat transferring fin 147 may be formed in a plate shape and a plurality of plates may be stacked above each other, with space between each adjacent pair of heat transferring fins 147. Each heat transferring fin 147 may have a plurality of openings through which the freezing cores may be inserted. In order to promote efficiently thermal transfer, the circumference of each of opening may contact the surface of the freezing core 143 inserted therethrough. That is, each of the heat transferring fins 147 may be provided with a plurality of holes corresponding to a diameter of and spacing between the freezing cores 143. As stated above, the freezing cores 143 may be inserted in the holes of the heat transferring fins 147. Also as stated above, the heat transferring fins 147 may spaced apart from each other in a lengthwise or vertical direction of the freezing cores 143.

As the plurality of layers heat transferring fins 147 may be disposed to contact an outer surface of each of the freezing cores 143, the heat transfer by the cool air circulating in the ice-making unit 140 can be accomplished effectively.

Further, the freezing cores 143 and the heat transferring fins 147 may be provided above the ice tray 146 so that they are capable of moving upward and downward. The freezing cores 143 and the heat transferring fins 147 may be provided to also be capable of rotating as they move upward and downward.

The ice-making unit 140 may further include a control box 150 including mechanical components to enable the freezing cores 143 and the heat transferring fins 147 to move and rotate. The control box 150 may include a motor 156 (FIG. 4) that provides a driving force to the freezing cores 143 and the heat transferring fins 147, and a cam unit 152 (FIG. 4) that cooperatively interfaces with additional components introduced below to transfer a rotational driving force of the motor 156 into a vertical motion. The motor and the cam unit will be described in more detail later.

Meanwhile, the ice tray 146 may be designed to be coupled to the control box 150 and rotate as the freezing cores 143 and the heat transferring fins 147 are fixed and remain stationary. The structure of the control box 150 and the operation of the freezing cores 143 and the ice tray 146 will be described in more detail with reference to the accompanying drawings.

The cool air inlet 102 may be provided above the ice-making device 100. The cool air inlet 102 may be designed to supply the cool air introduced from the freezing chamber 12 to the ice-making device 100 in a state where the chilling door 13 is closed. As previously described, the cool air inlet 102 may be coupled to the duct supply hole 22*a* when the chilling door 13 is closed.

In addition, a cool air passage (not shown) along which the cool air flows may be provided under the cool air inlet 102. The cool air may be introduced through the cool air inlet 102. A cool air supply 142, through which the cool air is introduced into the ice-making unit 140, may be formed at a first end of the cool air passage.

A cool air discharge 144, through which the cool air flowing about the freezing cores 143 and the ice tray 146 is discharged to the external side, may be formed on a side of the ice-making unit 140. The cool air discharge 144 may communicate with the cool air outlet 104 formed on a side surface of the ice-making device 100.

Accordingly, the cool air discharged through the cool air discharge 144 is directed to the freezing chamber 12 through the discharge duct 24 via the cool air outlet 104.

As described above, the cool air may be supplied from an upper portion of the ice-making unit 140 to a lower portion of the ice-making unit 140 and discharged toward a lower side of the ice-making unit 140. Therefore, the cool air may be uniformly supplied to the freezing cores 143, therefore enabling the water to freeze in a uniform manner.

Figure 3:
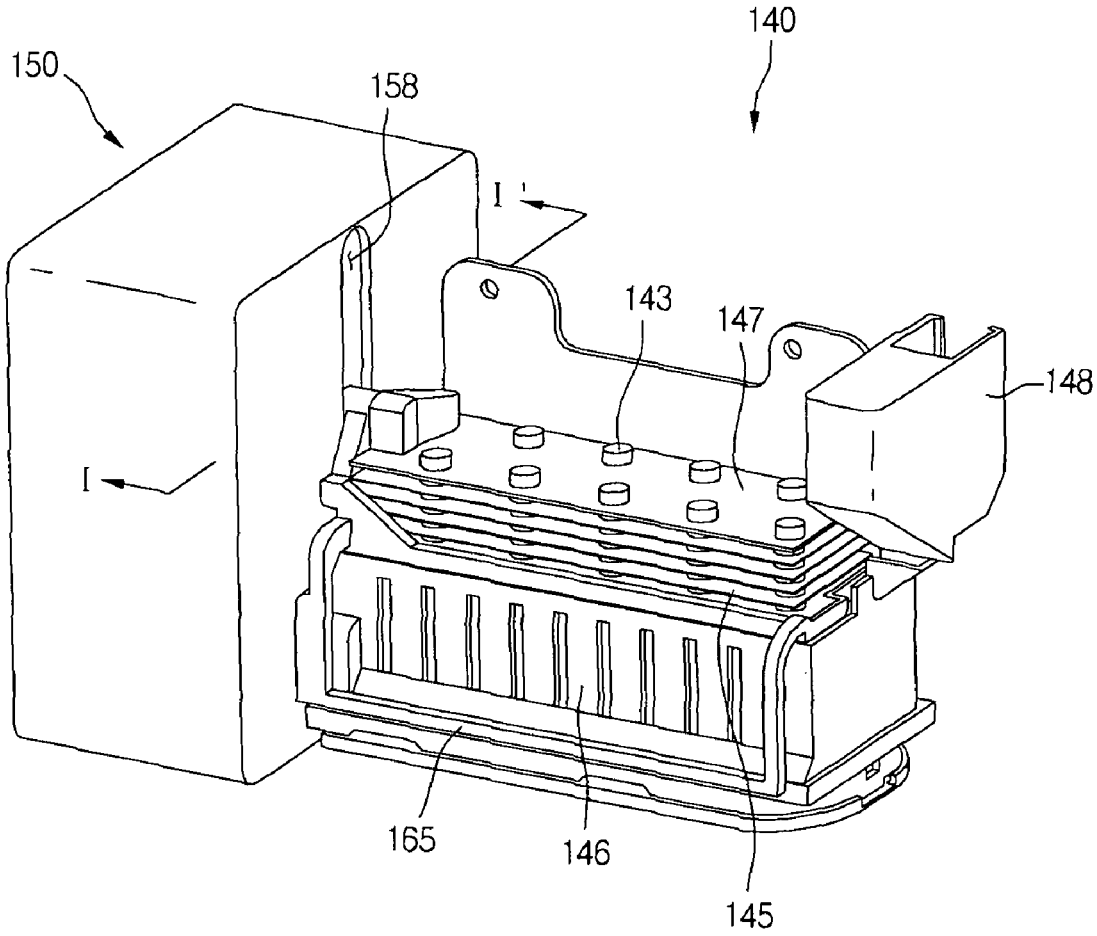
FIG. 3 is a perspective view of the ice-making device of FIG. 1.
Figure 4:
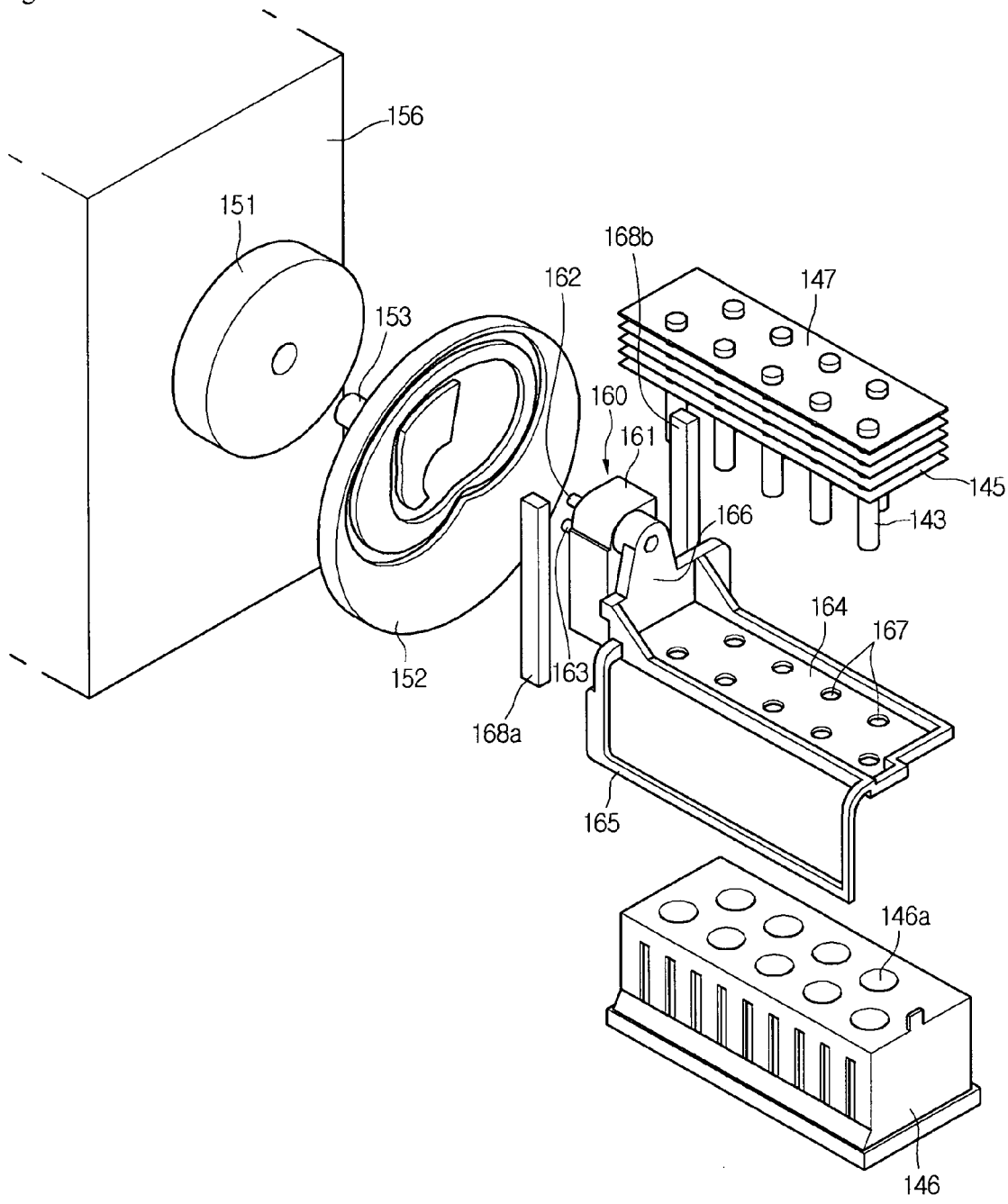
FIG. 4 is an exploded perspective view of the ice-making device of FIG. 3.

FIG. 3 is a perspective view of the ice-making device of FIG. 1, and FIG. 4 is an exploded perspective view of the ice-making device of FIG. 3.

Referring to FIGS. 3 and 4, the ice-making unit 140 of the embodiment includes the water supply unit 148 for storing water introduced from an external source, the ice tray 146 in which the water is supplied from the water supply unit 148 and frozen into ice, the freezing cores 143 provided above the ice tray 146 and forming an ice core by cold supplied by the cool air to the water stored in the ice tray 146, and the heat transferring fins 147 for enhancing the heat transfer of the freezing cores 143.

As shown in FIG. 4 in more detail, the ice tray 146 is provided with a plurality of ice-making spaces 146*a*, ready to receive the water supplied from the water supply unit 148. First ends of the freezing cores 143 are received in the respective ice-making spaces 146*a*.

Accordingly, the number of the ice-making spaces 146*a* may be same as that of the freezing cores 143. The water supplied to the ice-making spaces 146*a* may be expediently frozen by the contact of the water to the freezing cores 143.

A lower portion of the ice-making spaces 146*a* may be rounded and thus a lower portion of each of the resulting ice cubes made in the respective ice-making spaces 146*a* may be rounded. Hence, the ice cubes have an improved outer appearance, satisfying consumers.

In addition, the heat transferring fins 147 are spaced apart from each other in the lengthwise direction of the freezing cores 143. The heat transferring fins 147 are provided with a plurality of holes in which the freezing cores 143 are inserted. Here, the number of the insertion holes in each heat transferring fin 147 may be the same as the number of freezing cores 143.

Further, an ice separation heater 145 is provided under the heat transferring fins 147 to separate the ice cubes made by the freezing cores 143. A lowermost one of the heat transferring fins may function as the ice separation heater 145. That is, the heat transferring fins 147, except for the lowermost heat transferring fin, function to freeze the water while the lowermost heat transferring fin functions as the ice separation heater 145 for separating the ice cubes from the freezing cores 143. Thus, the ice separation heater 145 may be separately controlled by a controller (not shown) to raise the temperature thereof.

Meanwhile, another heater (not shown) may be provided at a side of the ice making spaces 146*a* of the ice tray 146 to cause separation of the ice cubes, made by the freezing cores 143, from the ice tray 146.

In addition, a temperature sensor (not shown) may be provided at a side of the ice tray 146 to detect a surface temperature of the ice tray 146. The operation of the heater of the ice tray 146 may be controlled by the temperature sensor and/or a controller.

According to one embodiment, when the heater of the ice tray 146 operates during the ice separation process, the surface temperature of the ice tray 146 increases over a predetermined limit and then the temperature sensor detects this. The heater of the ice tray 146 will stop operating in accordance with detection of the predetermined temperature value.

In addition, provided between the ice tray 146 and the freezing cores 143 is a guide unit 160 that may guide the vertical and rotational motions of the freezing cores 143. That is, the freezing cores 143 may be caused to move and rotate as dictated by the guide unit 160.

As shown in FIG. 4, the guide unit 160 may include a seating portion 164 upon which the heat transferring fins 147 and the freezing cores 143 may be seated. The seating portion 164 may be shaped and sized to correspond to the lowermost heat transferring fin (i.e., the ice separation heater 145). Further, disposed between the seating portion 164 and the ice separation heater 145 may be a connecting member (not shown) connecting the seating portion 164 to the ice separation heater 145.

When the seating portion 164 is connected to the ice separation heater 145, the heat transferring fins 147 and the freezing cores 143 move and rotate in accordance with the movement of the guide unit 160.

The seating portion 164 may be provided with insertion holes 167 through which the freezing cores 143 are inserted. Further, the insertion holes 167 of the seating portion 164 may be formed to correspond to the insertion holes of the heat transferring fins 147.

An extending portion 166, extending upward from the seating portion 164 in a vertical direction, may be formed at a side of the seating portion 164.

The guide unit 160 may include first and second shafts 162 and 163, and a moving member 161. The first and second shafts 162 and 163 guide the movement or rotation of the guide unit 160 and may be provided at a side of the extending portion 166. The moving member 161 receives the shafts 162 and 163, or may be integrally formed with the shafts 162 and 163.

The moving member 161 is coupled to the extending portion 166 such that it integrally rotates together with the extending portion 166. It is noted that the moving member 161 may be integrally formed with the extending portion 166.

The shafts 162 and 163 may protrude outwardly from a side of the moving member 161. The shafts 162 and 162 are spaced apart from each other and may be arranged in a lengthwise direction of the moving member 161.

Shafts 162 and 163 may be directly connected to the extending portion 166. That is, the moving member 161 may be omitted, while the extending portion 166 and the seating portion 164 may move and rotate directly by the movement of the shafts 162 and 163 in the cam unit 152.

Provided at both sides of the moving member 161 are moving guides 168*a* and 168*b* (FIG. 8A) guiding the movement of the moving member 161. The moving guides 168*a* and 168*b* may be referred to as first and second moving guides 168*a* and 168*b*, respectively. The first moving guide 168*a* may be provided at a first side of the moving member 161 and the second moving guide 168*b* may be provided at a second side of the moving member 161. The first and second moving guides 168*a* and 168*b* may be fixed on an inside of the control box 150.

The first moving guide 168*a* may be slightly longer than the second moving guide 168*b* so that a lower portion of the moving member 161 does not interfere with the second moving guide 168*b* when moving member 161 rotates. Depending on the direction of rotation of the moving member 161, the first moving guide 168*a* may be shorter than the second moving member 168*b*. Therefore, if the lower portion of the moving member 161 is designed to rotate toward the first moving guide 168*a*, the first moving guide 168*a* is designed to be shorter than the second moving guide 168*b*.

A driving motor 151 disposed at one side of the shaft 162 and 163 provides driving force for moving and rotating the guide unit 160. A cam unit 152 acts to transfer the driving force generated by the driving motor 151 to the guide unit 160. That is, the cam unit 152 functions as a power transmission unit.

A motor shaft 153 is coupled to the driving motor 151 and is driven in a rotational direction by the driving motor 151. The motor shaft 153 is connected to, or formed integrally with, the cam unit 152 and the cam unit 152 rotates in a predetermined direction by the rotation of the motor shaft 153.

The cam unit 152, shafts 162 and 163, and moving member 161 transfer the rotational power of the motor 151 to the freezing cores 143. During this process, the cam unit 152 functions as a power transmission unit focusing the rotational force of the motor 151 into a predetermined directional path for the freezing cores 143 to follow.

The extending portion 166, shafts 162 and 163, moving member 161, cam unit 152, and driving motor 151 may all be disposed in a case 156 defining an exterior of the control box 150. The case 156 of the control box 150 may be separately provided and defines a predetermined space inside thereof.

The control box 150 may be provided at a side of the ice-making unit 140 and may have a through hole or slot 158 (FIG. 3) through which the extending portion 166 may be passed through into the control box 150. That is, the extending portion 166 of the guide unit 160, shafts 162 and 163, moving member 161, cam unit 152, and driving motor 151 may be disposed at a first side of the through hole or slot 158 and the seating portion 164 of the guide unit 160, freezing cores 143, and ice tray 146 may be disposed at a second side of the through hole or slot 158.

The guide unit 160 may be provided with a tilt preventing portion 165 for preventing the seating portion 164 from drooping or tilting in a predetermined direction when the guide unit 160 moves and rotates. The tilt preventing portion 165 may be bent from a side of the seating portion 164 and extend downwardly therefrom. A first side of the tilt preventing portion 165 may be disposed adjacent to a side surface of the case 156.

In more detail, the seating portion 164 has a first end that is supported on the moving member 161 by the extending portion 166 and a second end that is free. In this case, the second end of the seating portion 164 does not tilt or droop downward when the guide unit 160 moves and rotates.

However, a first side of the tilt preventing portion 165 extends downward such that it is adjacent to the case 156 and the tilt preventing portion 165 and the case 156 interact with each other. The case 156 may support a side of the tilt preventing portion 165 thus preventing the drooping of the seating portion 164.

Figure 5:
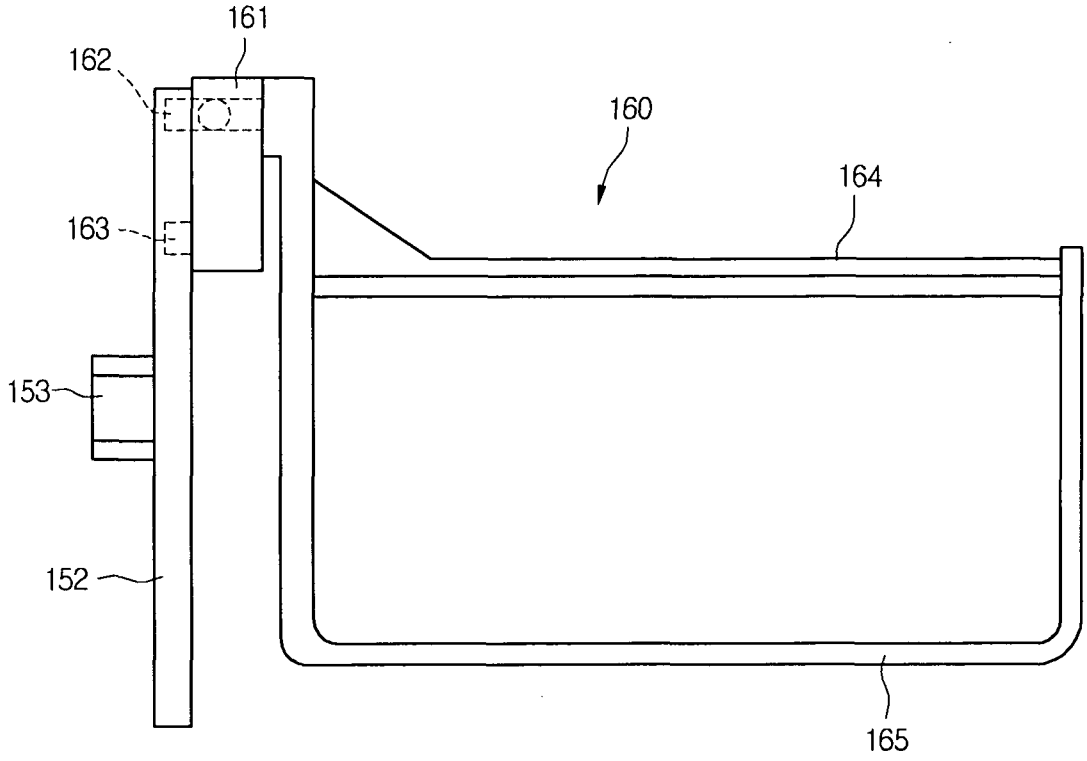
FIG. 5 is a side view of a power transmission mechanism of the ice-making device of FIG. 3.
Figure 6:
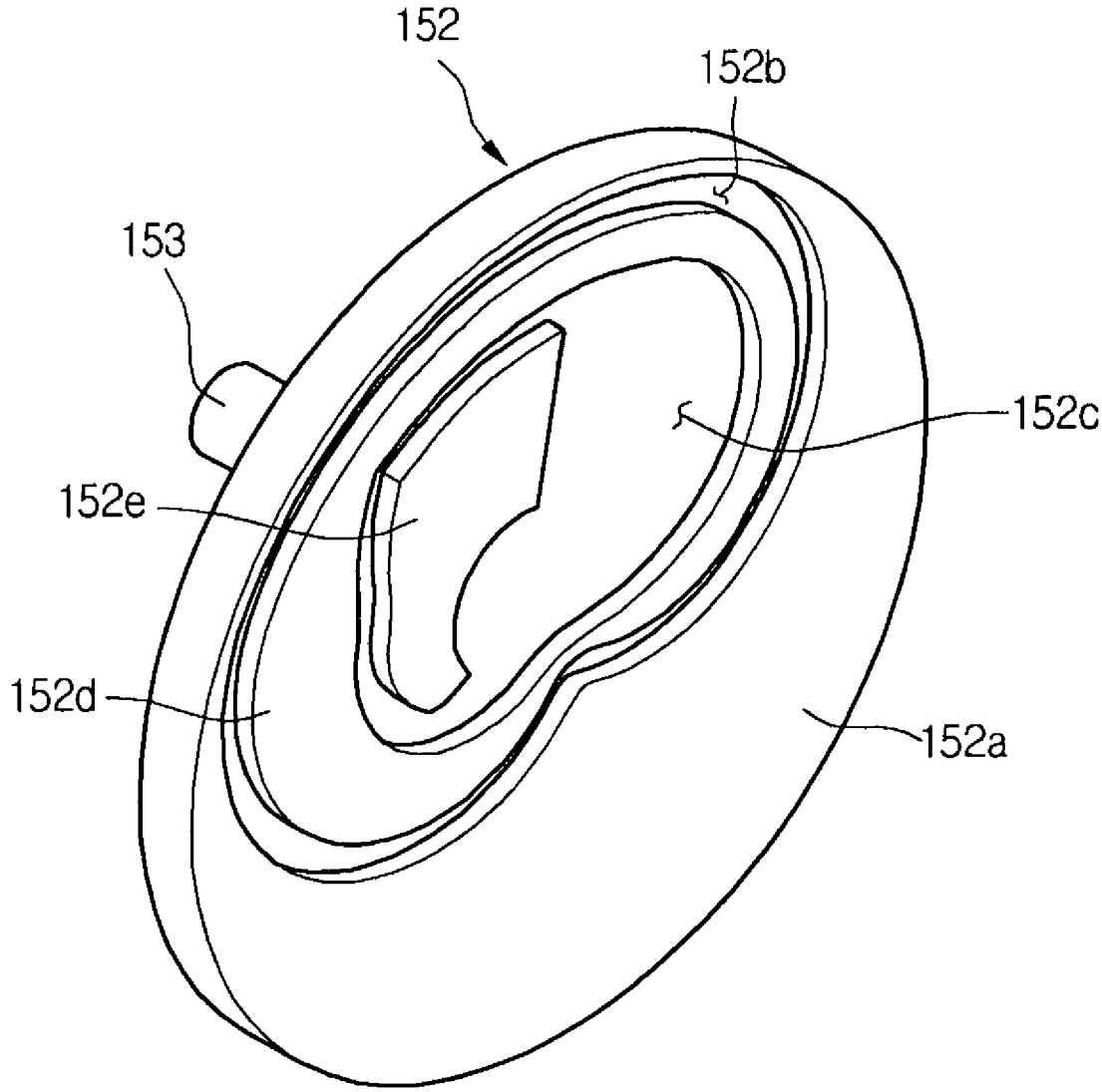
FIG. 6 is a perspective view of a cam unit according to an embodiment of the invention.
Figure 7:
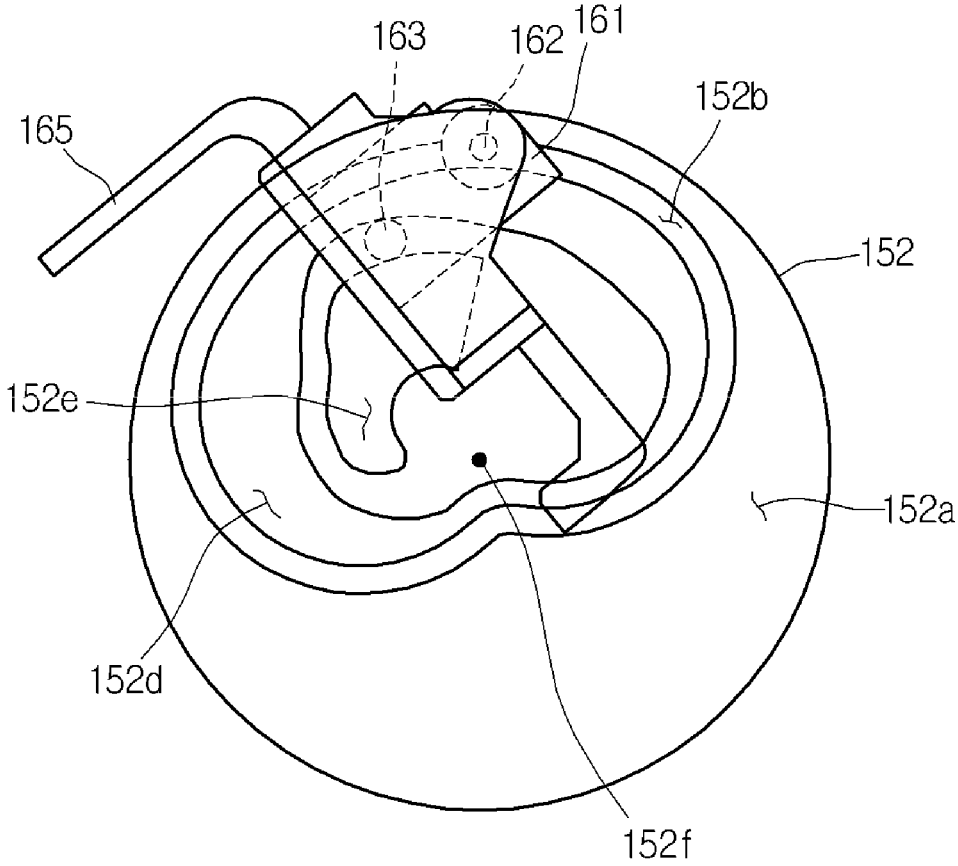
FIG. 7 is a view illustrating rotational operation of a guide unit together with a cam unit according to an embodiment of the invention.

FIG. 5 is a side view of a power transmission mechanism of the ice-making device of FIG. 3, FIG. 6 is a perspective view of a cam unit according to an embodiment, and FIG. 7 is a view illustrating rotational operation of a guide unit together with a cam unit according to an embodiment.

The following will describe a power transmission mechanism for moving and rotating the guide unit 160 according to the first embodiment with reference to FIGS. 5 to 7.

The driving motor 151 and the cam unit 152 may be interconnected by the motor shaft 153. Therefore, when the driving motor 151 operates, the motor shaft 153 and the cam unit 152 rotate in an identical direction. Further, the first and second shafts 162 and 163 may be coupled to the cam unit 152.

With reference to the embodiment shown in FIG. 6, the following will describe the structure of the cam unit 152. The cam unit 152 includes a main body 152*a* formed in a circular plate-like shape. An outer groove 152*b*, is formed on the main body 152*a* and is adapted to receive the first shaft 162. An inner groove 152*c* is also formed on the main body 152*a* and is adapted to receive the second shaft 163. The grooves 152*b* and 152*c* may be referred to as guide grooves for guiding the predetermined directional movement of the first and second shafts 162 and 163.

In more detail, the outer and inner grooves 152*b* and 152*c* may be formed as curved paths having different rotational radii from a rotational center of the cam unit 152. In the exemplary embodiment, the first and second grooves 152*b* and 152*c* are formed in a roughly "heart-like" shape.

Formed between the outer and inner grooves 152*b* and 152*c* is a first protrusion 152*d* defining a boundary between the outer and inner grooves 152*b* and 152*c* and guiding the movement of the first shaft 162. Formed in the inner groove 152*c* is a second protrusion 152*e* for guiding the movement of the second shaft 163. An outer surface of the second protrusion 152*e* is formed in an approximately "ㄱ" shape, or in other words, an inverted mirror image of the capital letter "L".

The first and second protrusions 152*d* and 152*e* may be elevated to substantially the same height as a top surface of the main body 152*a*. That is, the first and second protrusions 152*d* and 152*e* protrude relative to the outer and inner grooves 152*b* and 152*c*.

The shafts 162 and 163 are guided along outer surfaces of the protrusions 152*d* and 152*e*, that is, they are guided within the grooves 152*b* and 152*c*.

A rotational center 152*f* (FIG. 7) of the cam unit 152 is formed at a point of the inner groove 152*c*, i.e., at an approximately central portion of the cam unit 152. The inner and outer grooves 152*b* and 152*c* have different rotational radii with reference to the rotational center 152*f*. Therefore, the first and second shafts 162 and 163 move along different directional paths while moving within the inner and outer grooves 152*b* and 152*c* as the motor 151 rotates.

Because the moving member 161 is connected to the first and second shafts 162 and 163, the moving member 161 moves and rotates in accordance with the movement of the first and second shafts 162 and 163.

Because the extending and seating portions 166 and 164 are connected to the moving member 161, the extending and seating portions 166 and 164 ascend, descend, and rotate as the moving member 161 moves. Further, since the freezing cores 143 are inserted through the seating portion 164 and the heat transferring fins 147 are seated on an upper portion of the seating portion 164, they move in an identical direction as the seating portion 164 moves.

FIGS. 8A to 8D are sectional views taken along line I-I' in FIG. 3, illustrating rotational operation of the shafts and moving member by the cam unit according to an embodiment.

As illustrated in the exemplary illustrations of FIGS. 8A to 8D, the shafts 162 and 163 are fixed to the moving member 161. First ends of the shafts 162 and 163 are inserted in the respective grooves 152*b* and 152*c* formed on the cam unit 152. The shafts 162 and 163 and the moving member 161 can move and rotate in conjunction with the rotation of the cam unit 152 along the directional path defined by grooves 152*b* and 152*c*.

Figure 8A:
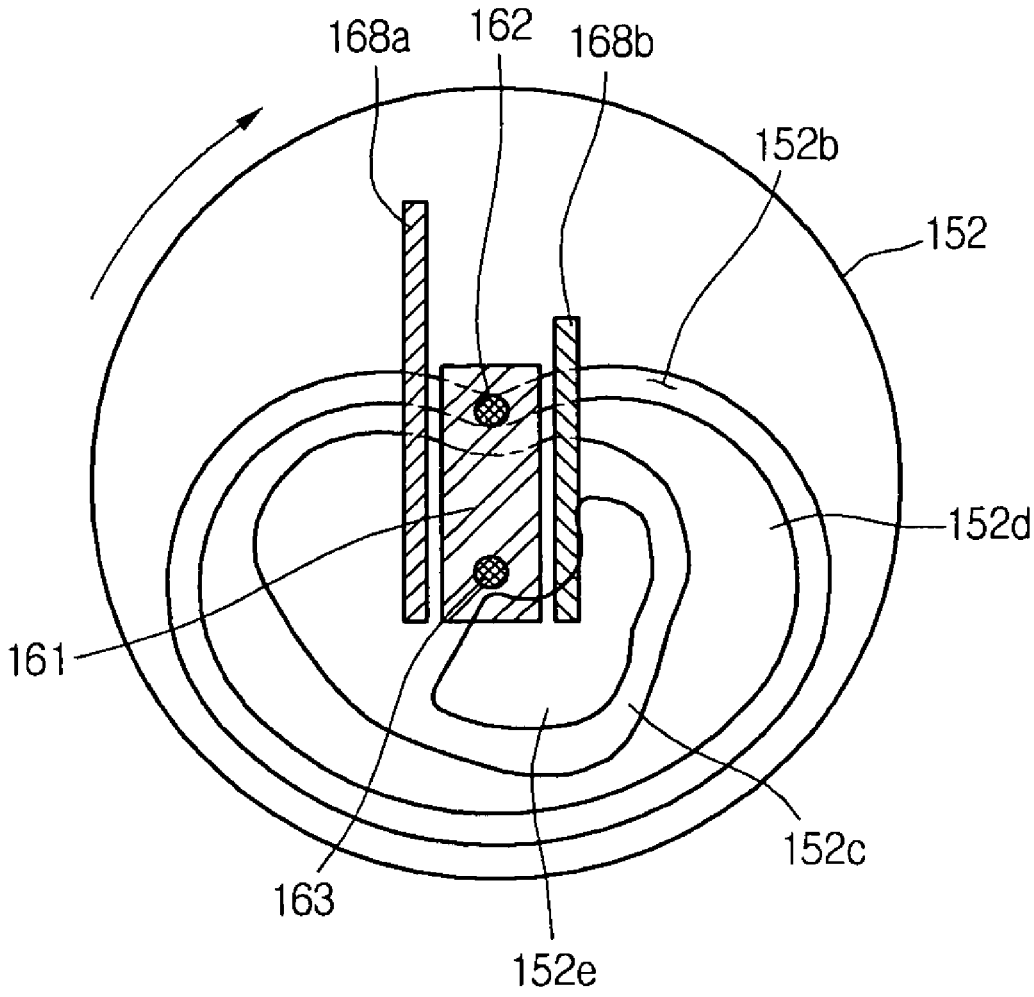
FIGS. 8A to 8D are sectional views taken along line I-I', illustrating rotational operation of shafts and a moving member of an ice-making device by a cam unit, all according to an embodiment of the invention.
Figure 8B:
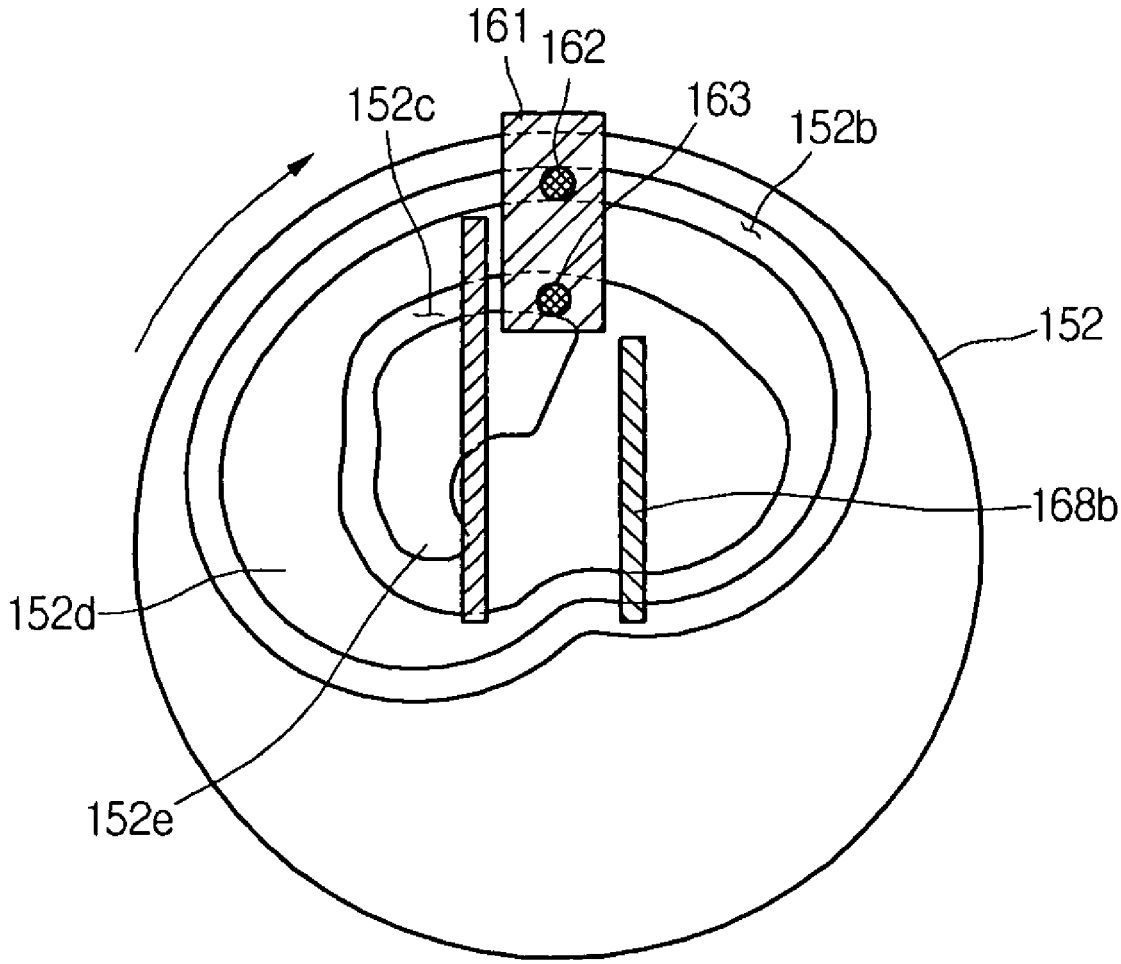
Figure 8C:
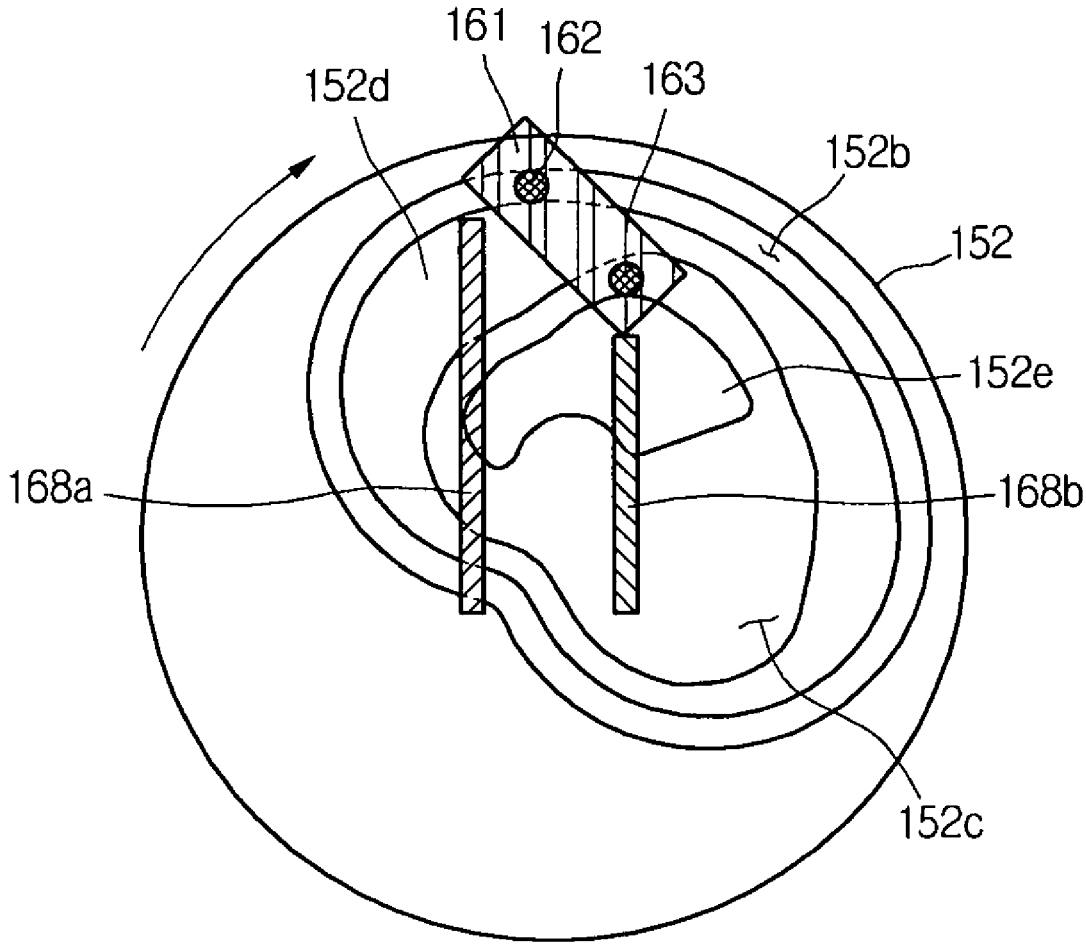
Figure 8D:
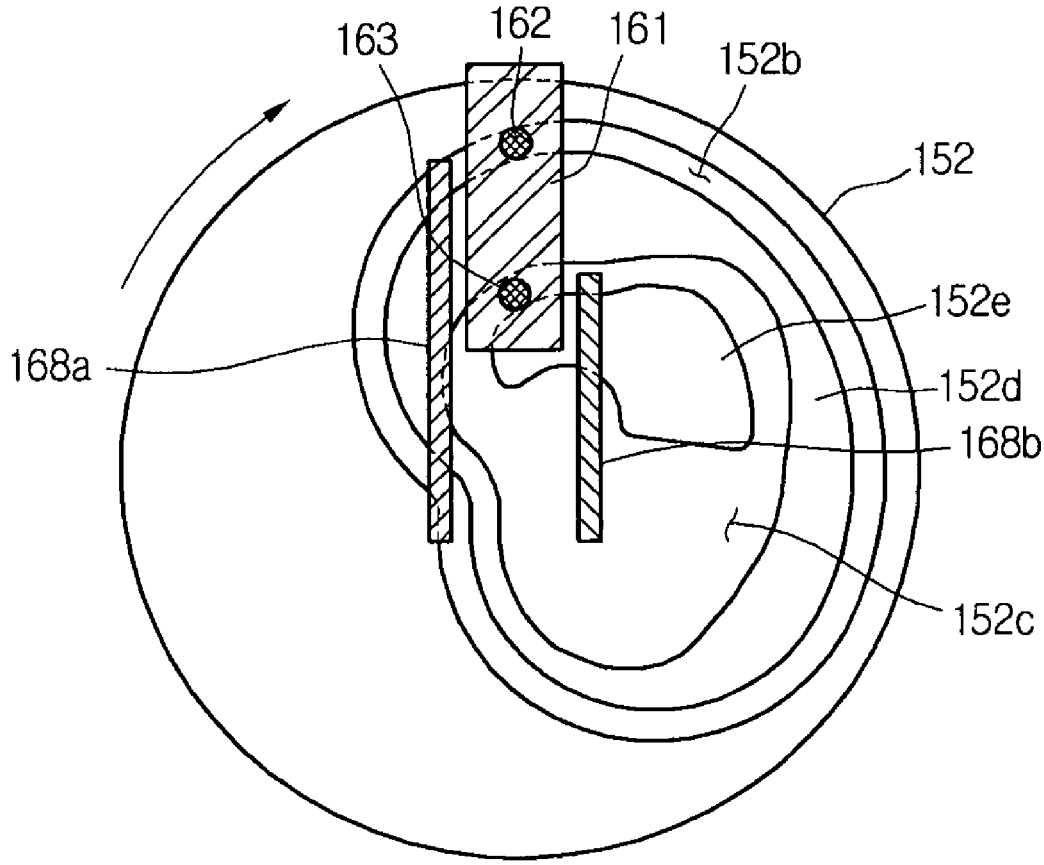

FIGS. 8A to 8D illustrate a case where the cam unit 152 rotates clockwise. FIG. 8A shows initial positions of the shafts 162 and 163 and the moving member 161 while ice-making is taking place in the ice tray 146. FIG. 8B shows positions of the shafts 162 and 163 and the moving member 161 in a state where the freezing cores 143 have ascended completely in the vertical direction. FIG. 8C shows positions of the shafts 162 and 163 and the moving member 161 in a state where the rotation of the freezing cores 143 is completed. FIG. 8D shows positions of the shafts 162 and 163 and the moving member 161 in a state where the freezing cores 143 are returned to the initial position and the shafts 162 and 163 are positioned for a descent in the vertical direction. It is noted that the cam unit 152 may rotate counterclockwise by the driving motor 151 and the shape of groves 152*b* and 152*c* may be modified to obtain the resulting movement described above.

Returning to FIG. 8A, in the initial position of the ice-making process, the first shaft 162 is located within the outer groove 152*b* and the second shaft 163 is located within the inner groove 152*c*. The second shaft 163 is supported on a side of the second protrusion 152*e*.

In this state, when the cam unit 152 rotates clockwise, the first shaft 162 moves along the outer groove 152*b* and the second shaft 163 moves along the inner groove 152*c*. The first and second shafts 162 and 163 are thus guided to ascend in the vertical direction. At this point, the moving member 161 also ascends in the vertical direction.

Referring to FIG. 8B, in the position where the vertical ascent of the freezing cores 143 is completed, the second shaft 163 may be supported on a side of the second protrusion 152*e*.

As illustrated in FIG. 8C, as the cam unit 152 continues to rotate, the shafts 162 and 163 vary in their moving distances and directions as a result of the different rotational radius between the grooves 152*b* and 152*c*. Accordingly, the moving member 161 is guided to rotate about the first shaft 162 counterclockwise.

During this process, the freezing cores 143 rotate with the moving member 161, and withdraw the ice cubes from the ice tray 146, and the ice cubes are subsequently separated from freezing cores 143. As the freezing cores 143 are rotated, the ice cubes will then fall down. Here, in order to ensure enough time for separating the ice cubes from the freezing cores 143, the freezing cores 143 may remain in the rotated position for a predetermined time.

Referring to FIG. 8D, after the ice cubes are separated from the freezing cores 143 and fall down, the cam unit 152 continues rotating. The shafts 162 and 163 are then guided along the grooves 152*b* and 152*c* and thus the moving member 161 can be returned to the initial position discussed above.

In this state, when the cam unit 152 keeps rotating, the shafts 162 and 163 and the moving member 161 move downward in the vertical direction to the initial position of the ice-making process shown in FIG. 8A.

That is, when the cam unit 152 rotates one turn, the moving member 161 is in a vertical orientation and ascends in the vertical direction, rotates in a first direction to a predetermined angle, rotates in a second direction, which is opposite to the first direction, to return to the vertical orientation, and descends in the vertical direction to return back to the initial position.

The following description will be made of alternative embodiments of the guide unit of FIG. 7. Only the differences will be described and like reference numbers will be used to refer to like parts.

Figure 9:
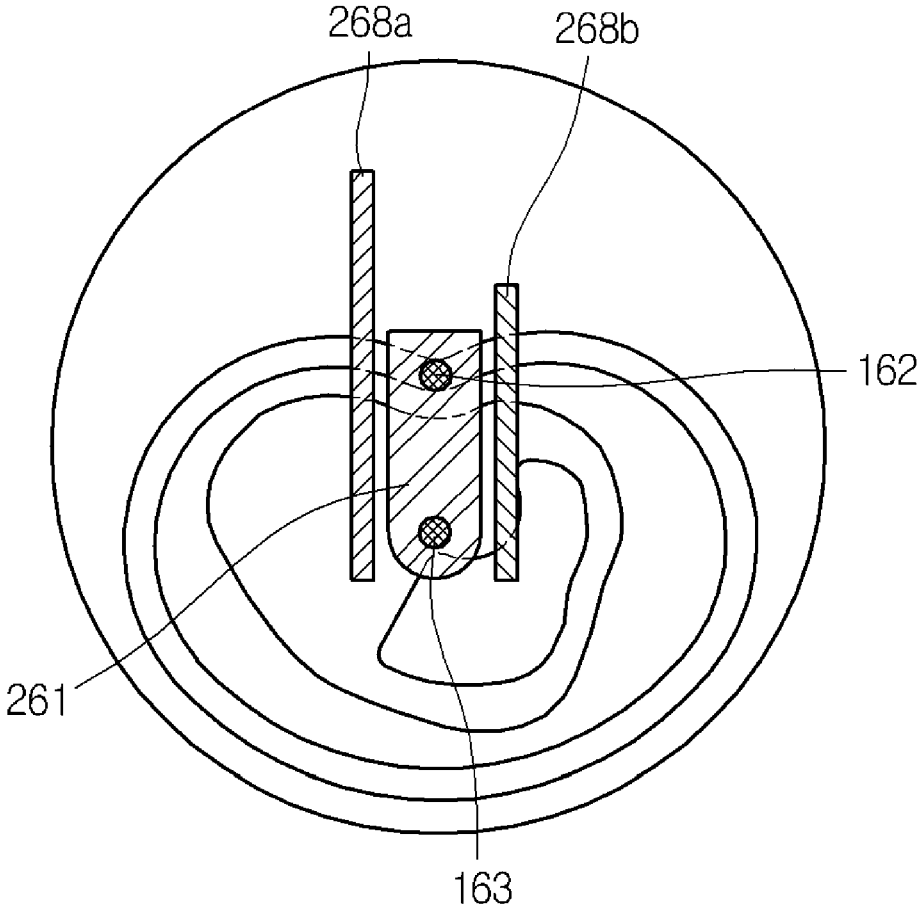
FIG. 9 is a view of a first modified example of a guide unit of FIG. 7 according to another embodiment of the invention.

FIG. 9 is a view of a first modified example of a guide unit of FIG. 7.

Referring to FIG. 9, provided at both sides of a moving member 261 are first and second moving guides 268*a* and 268*b* that guide the vertical movement of the moving member 261. In the exemplary embodiment of FIG. 9, a lower portion of the moving member 261 is rounded so as to reduce the interference with the second moving guide 268*b* when the moving member 261 rotates toward the second moving guide 268*b*.

A larger space between the rounded end of the moving member 261 and the second moving guide 268*b* is thus obtained. The second moving guide 268*b* can therefore be lengthened relative to the larger space, yet still allow the rotational movement without interference.

As the length of the second moving guide 268*b* increases, the guide length of the moving member 261 increases. Therefore, the stability of the moving member 261, while it is moving, can be enhanced.

Figure 10:
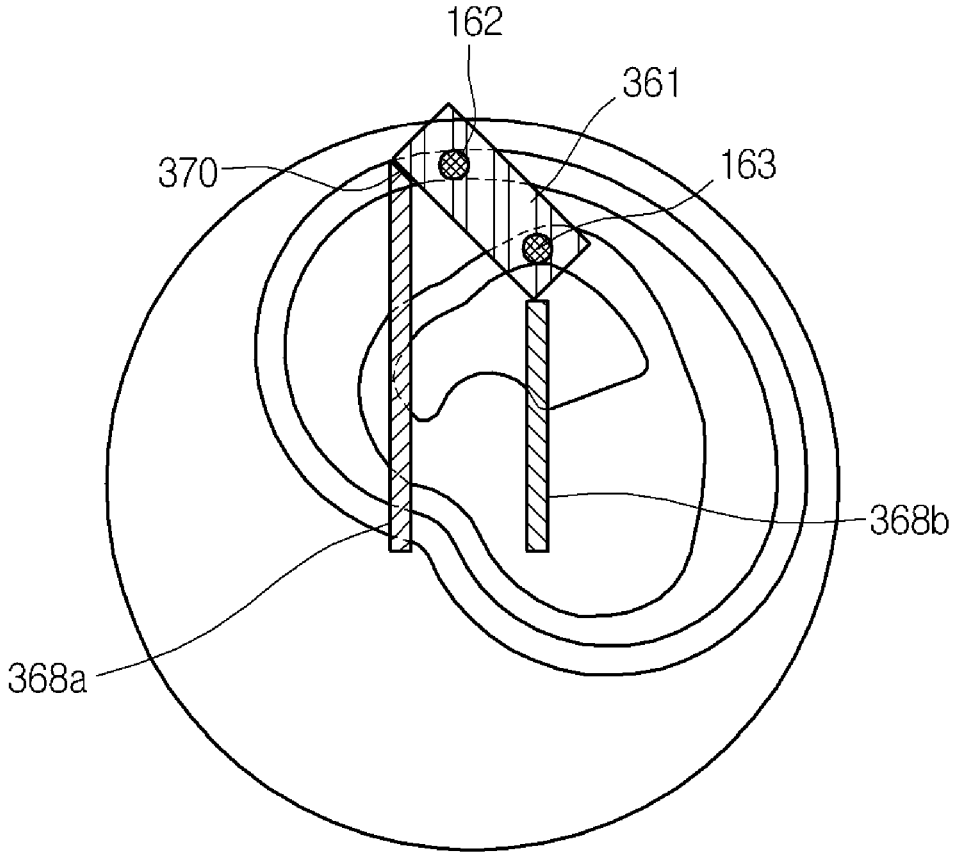
FIG. 10 is a view of a second modified example of a guide unit of FIG. 7 according to still another embodiment of the invention.

FIG. 10 is a view of a second modified example of the guide unit of FIG. 7.

Referring to FIG. 10, first and second moving guides 368*a* and 368*b* are provided at both sides of a moving member 361 of this modified example. The moving guides 368*a* and 368*b* guide the vertical movement of the moving member 361.

A rotational limit portion 370 is formed on a first side end of the first moving guide 368*a*. The rotational limit portion 370 functions to support a side of the moving member 361 in a state where the moving member 361 rotates in a predetermined direction.

The rotational limit portion 370 may define a seat inclined in a direction corresponding to the side of the moving member 361 that approaches the first guide member 368*a* as the moving member 361 rotates in the predetermined direction.

That is, when the moving member 361 rotates at a predetermined angle, the side of the moving member 161 contacts the rotational limit portion 370. The moving member 361 is then prevented from further rotation.

Then, as the cam unit 152 continues to rotate, rotational limit portion 370 aides the moving member 361 to return to an initial position.

In this embodiment, there is no need to form the inner groove 152*c* on the cam unit 152. Therefore, the structure of the cam unit 152 can be simplified.

According to the above described embodiments, the freezing cores of the ice tray can be advantageously moved in the vertical direction and rotate as the moving portion is guided by the cam unit. Thus, the ice can effectively be released from the ice tray and the freezing cores and fall down into an ice bank. That is, the ice separation can be efficiently and advantageously realized by the simple structures as shown and described in an exemplary manner.

In more detail, the shafts 162, 163 move in a vertical and rotational direction in accordance with the guidance of the cam unit and its structure having the guide grooves formed therein. Therefore, the freezing cores or the ice tray can easily move without using a separate device.

Further, because the shafts coupled to the moving member and freezing cores rotate and move via the driving unit efficiently within a necessary range, the power consumption can be reduced.

Furthermore, when the cam unit completes a full rotation, the shafts will return to their initial positions. Accordingly, the control of the driving motor for separating the ice can be easily realized.

Although embodiments have been described with reference to a number of illustrative embodiments thereof, it should be understood that numerous other modifications and embodiments could be devised by those skilled in the art that will fall within the spirit and scope of the principles of this disclosure. More particularly, various variations and modifications are possible in the component parts and/or arrangements of the subject combination arrangement within the scope of the disclosure, the drawings, and the appended claims. In addition to variations and modifications in the component parts and/or arrangements, alternative uses will also be apparent to those skilled in the art.

For example, the moving member may be connected to the ice tray. That is, when the moving member rotates and moves by the driving motor, the power of the moving member is transferred to the ice tray and thus the ice tray can move in the vertical direction and rotate.

When the ice cubes are separated from the freezing cores in a state where the ice tray moves in the vertical direction and rotates, the ice cubes fall down while being guided along the outer surface of the ice tray.

What is claimed is:

1. An ice-making device for a refrigerator, comprising:
an ice tray defining an ice-making space;
a freezing core that is partially received in the ice-making space to form ice at an end thereof;
a driving unit generating a driving force that causes vertical and rotational movement of the freezing core; and
a power transmission unit to transfer power from the driving unit to the freezing core, the power transmission unit comprising:
a cam rotatably connected to the driving unit; and
a moving member communicating with the cam and following a vertical and a rotational path as guided by the cam; and
a first shaft coupled to the moving member, the first shaft extending from a surface of the moving member in a first direction;
a second shaft disposed at a site spaced apart from the first shaft in a lengthwise direction of the moving member for guiding a vertical movement of the moving member, the second shaft extending from the surface of the moving member in the first direction;
wherein the cam includes:
a main body;
guide grooves formed at the main body, the grooves comprising a first groove receiving at least a portion of the first shaft and a second groove receiving at least a portion of the second shaft, and wherein the second groove surrounds the first groove;
a first protrusion defining a boundary between the first and second guide grooves to guide the movement of the first shaft; and
a second protrusion disposed at inner side of the first protrusion to guide the movement of the second shaft, the second protrusion being surrounded by the first groove.

2. The ice-making device according to claim 1, wherein a moving guide is provided at a side of the moving member to guide movement thereof.

3. The ice-making device according to claim 2, wherein a rotating limit portion is formed at an end portion of the moving guide to control rotation of the moving member.

4. The ice-making device according to claim 3, wherein the rotating limit portion is inclined to correspond to a rotational direction of the moving member.

5. The ice-making device according to claim 1, wherein a lower end of the moving member is rounded.

6. An ice-making device for a refrigerator, comprising:
an ice tray defining an ice-making space;
a freezing core that is partially received in the ice-making space to form ice at an end thereof;
a drive unit generating a rotational drive force to move and rotate the freezing core;
a cam receiving the drive force and rotating in accordance with the drive unit, the cam provided with a first and a second guide groove formed in a predetermined surface of the cam that is parallel to a plane of rotation of the cam;
a moving member receiving the drive force from the cam to transfer the drive force to the freezing core, the moving member comprising first and second shafts extended outwardly in a same direction from a surface of the moving member to be received in the first and second grooves, respectively; and
moving guides disposed at both sides of the moving member, the moving guides comprising a first moving guide and a second moving guide being approximately parallel to the first moving guide,
wherein the moving member moves in a space defined between the first moving guide and the second moving guide,
wherein the cam includes:
a first protrusion defining a boundary between the first and second guide grooves to guide the movement of the first shaft; and
a second protrusion disposed at inner side of the first protrusion to guide the movement of the second shaft, the second protrusion being surrounded by the first groove.

7. The ice-making device according to claim 6, further comprising a seating portion, which receives the freezing core and moves in response to movement of the first and second shafts.

8. The ice-making device according to claim 7, further comprising an extending portion coupled to the first and second shafts and extending toward the seating portion.

9. The ice-making device according to claim 7, wherein a heat transferring fin is seated on the seating portion and effectuates heat transfer with the freezing core.

10. The ice-making device according to claim 6, wherein the first and second grooves are defined by curved paths, the curved paths, the curved paths having different radii relative to a rotational center of the cam unit.

11. The ice-making device according to claim 6, wherein at least the second groove defines a heart-like pattern on the surface of the cam that is parallel to the plane of rotation of the cam.

12. The ice-making device according to claim 6, the moving member follows a predetermined vertical and rotational path according to moving of the first and second shafts.

13. The ice-making device according to claim 12, the vertical and rotational path of the moving member having a starting point corresponding to a rotational position of the cam, wherein the moving member is returned to the starting point after a full rotation of the cam.

14. An ice-making device for a refrigerator, comprising:

an ice tray to receive water;

a driving motor to generate a driving force;

a freezing core movable along a vertical and rotational path;

a cam transferring the driving force to effect movement of the freezing core;

a plurality of shafts movably received in the cam and transferring the driving force to the freezing core, the plurality of shafts comprising a first shaft and a second shaft disposed at a surface of a moving member, wherein the second shaft is spaced apart from the first shaft in a lengthwise direction of the moving member;

wherein the cam comprises:

curved guide grooves guiding vertical and rotational movement of the shafts about a rotational center, the curved guide grooves having different radii with respect to the rotational center, the curved guide grooves comprising a first guide groove and a second guide groove surrounding the first guide groove;

a first protrusion defining a boundary between the first and second guide grooves to guide the movement of the first shaft; and a second protrusion disposed at inner side of the first protrusion to guide the movement of the second shaft, the second protrusion being surrounded by the first groove.

15. The ice-making device according to claim 14, wherein the shafts are guided along outer surfaces of the first and second protrusions.

16. The ice-making device according to claim 14, wherein the first groove has a different shape from the second groove.

17. The ice-making device according to claim 14, further comprising a moving member having a first side coupled to the shafts and a second side coupled to the freezing core.

* * * * *